US007134234B1

(12) United States Patent
Makarounis

(10) Patent No.: US 7,134,234 B1
(45) Date of Patent: Nov. 14, 2006

(54) MOUNTING DEVICE

(76) Inventor: John Makarounis, 2173 S. Nielson St., Gilbert, AZ (US) 85296

( * ) Notice: Subject to any disclaimer, the term of this patent is extended or adjusted under 35 U.S.C. 154(b) by 31 days.

(21) Appl. No.: 11/043,678

(22) Filed: Jan. 25, 2005

(51) Int. Cl.
*F41G 1/35* (2006.01)
*F41G 1/00* (2006.01)

(52) U.S. Cl. ..... 42/146; 42/114; 42/124; 362/110

(58) Field of Classification Search ..... 42/90, 42/114, 124, 146; 362/110; D22/108
See application file for complete search history.

(56) References Cited

U.S. PATENT DOCUMENTS

| | | | | | |
|---|---|---|---|---|---|
| 958,332 | A | * | 5/1910 | Snyder | 356/247 |
| 1,262,270 | A | * | 4/1918 | Schmidt et al. | 362/110 |
| 2,209,524 | A | * | 7/1940 | Key | 362/110 |
| 2,236,736 | A | * | 4/1941 | Scott | 362/110 |
| 2,314,061 | A | * | 3/1943 | Whaley | 362/110 |
| 2,450,584 | A | * | 10/1948 | Dodge | 362/114 |
| 3,354,570 | A | * | 11/1967 | Rizzo, Jr. | 42/146 |
| 4,348,716 | A | * | 9/1982 | Storm et al. | 362/188 |
| 4,777,754 | A | | 10/1988 | Reynolds, Jr. | |
| 5,040,322 | A | | 8/1991 | Iturrey, Jr. | |
| 5,282,594 | A | | 2/1994 | Huang | |
| 5,351,429 | A | * | 10/1994 | Ford | 42/115 |
| 5,581,898 | A | | 12/1996 | Thummel | |
| 5,621,999 | A | | 4/1997 | Moore | |
| 5,671,559 | A | * | 9/1997 | Ludaesher et al. | 42/1.08 |
| 5,758,448 | A | | 6/1998 | Thummel | |
| 5,784,823 | A | | 7/1998 | Chen | |
| 5,983,548 | A | * | 11/1999 | Ludaescher | 42/1.08 |
| 6,378,237 | B1 | | 4/2002 | Mathews et al. | |
| 6,385,893 | B1 | | 5/2002 | Cheng | |
| 6,393,752 | B1 | | 5/2002 | Oliver et al. | |
| 6,438,888 | B1 | | 8/2002 | Lin et al. | |
| 6,698,130 | B1 | * | 3/2004 | Yang et al. | 42/146 |
| 2002/0148153 | A1 | * | 10/2002 | Thorpe | 42/114 |

* cited by examiner

*Primary Examiner*—Michael J. Carone
*Assistant Examiner*—Bret Hayes
(74) *Attorney, Agent, or Firm*—Booth Udall, PLC

(57) ABSTRACT

A mounting device for removably mounting a tactical flashlight along side a firearm includes: a receiving member having a base and an offset flashlight receiver coupled thereto; and a clamping member removably coupled with the base. A method for removably mounting a tactical flashlight along side a firearm includes: removably coupling a mounting device to a front portion of a trigger guard; and removably coupling the flashlight to the mounting device along side the firearm so a tail cap of the flashlight is along side the front portion of the trigger guard. A tactical flashlight and firearm system includes: a firearm; a mini tactical flashlight; and a mounting device removably coupling the firearm and the flashlight together, the mounting device holding the flashlight along side the firearm so that a tail cap of the flashlight is along side a front portion of a trigger guard.

6 Claims, 5 Drawing Sheets

MOUNTING DEVICE

BACKGROUND

1. Technical Field

This document relates to a mounting device.

2. Background Art

When considering the need for a firearm for personal protection it is necessary to mention the need for a flashlight. Whether the gun is for police, for home defense, or for personal protection while operating a business or traveling, it is a fact that the majority of hostile encounters take place in low light conditions.

Conventional weapon-mounted lights for firearms are very expensive and, therefore, beyond the reach of many private citizens. Additionally, they require the firearm to have a special accessory rail for attachment of the light accessory to the gun. Furthermore, they do not allow a shooter to make use of any tactical flashlight he might already own.

Other conventional flashlight adapters make use of an existing flashlight. However, some require the firearm to have a separate special accessory rail for attachment of the light to the gun, or some require the shooter to purchase a separate special adapter and modify the firearm by drilling and tapping holes into it for the adapter to fit. Other conventional flashlight adapters place the flashlight under the barrel of the firearm which makes it very difficult to operate the controls of the flashlight without separate special equipment.

It is also important to note that when operating a weapon-mounted light that safe gun handling practices be employed. For example, when operating the light prior to identifying a threat, the shooter must be able to operate the light without placing a finger on the trigger or through the trigger guard. In the case that a friend or family member is encountered instead of a threat, one should not be illuminating them with a lighting device whose operation is dependent on a finger being placed on the trigger of the weapon.

SUMMARY

In an aspect, this document features a two-piece mounting device for removably mounting a tactical flashlight along side a firearm. The mounting device may include a receiving member piece comprising a base having a first thickness that separates a first internal surface and a first external surface and a first trigger guard channel defined in the first internal surface at a rear end portion of the base. The receiving member piece may also include an offset, penannularly cylindrical, flashlight receiver comprising a flashlight receiving through hole and a notch extending along a longitudinal direction of the receiving through hole, the flashlight receiver coupled or integrally joined with a portion of the first external surface of the base. The mounting device may also include a clamping member piece removably coupled with the base. The clamping member may include a second thickness that separates a second internal surface and a second external surface and a second trigger guard channel defined in the second internal surface at a rear end portion of the clamping member.

Implementations may include one or more of the following. The offset, penannularly cylindrical, receiver may include opposing bottom and top flanges that extend outward from two sides of the notch, the top flange defining a first pair of spaced apart through holes, and the bottom flange comprising one of: a first pair of spaced apart screw rods that protrude outwardly from the bottom flange through the first pair of spaced apart through holes of the top flange; and a first pair of spaced apart threaded holes defined therein. The clamping member may include a second pair of spaced apart through holes located at a front end portion of the clamping member. The base may include one of: a second pair of spaced apart screw rods located at a front end portion of the base, the second pair of screw rods protruding outwardly from the first internal surface through the second pair of spaced apart through holes of the clamping member; and a second pair of spaced apart threaded holes defined in the first internal surface of the base at a front end portion of the base. The mounting device may include one of a first pair of nuts removably coupled with the first screw rods of the bottom flange and a first pair of screws removably coupled with the first pair of spaced apart through holes of the top flange and the first pair of spaced apart threaded holes of the bottom flange. The mounting device may include one of a second pair of nuts removably coupled with the second pair of screw rods of the base and a second pair of screws removably coupled with the second pair of spaced apart through holes of the clamping member and the second pair of spaced apart threaded holes of the base. Nuts may form a portion of the second pair of spaced apart threaded holes of the base. The mounting device may have contours in conformity with contours of the firearm. The base may include a first arcuate top surface and a first arcuate rear surface, and the clamping member piece may include a second arcuate top surface and a second arcuate rear surface having contours in conformity with contours of the firearm. A portion of an upper edge of the first external surface may be integrally joined with the receiver. The through hole of the receiver may be one of parallel to the base and at an angle with respect to the base.

In another aspect, this document features a method for removably mounting a tactical flashlight along side a firearm. The method may include: removably coupling a mounting device to a front portion of a trigger guard; and removably coupling the flashlight to the mounting device along side the firearm so a tail cap of the flashlight is along side the front portion of the trigger guard.

Implementations may include one or more of the following. Removably coupling a receiving member and a clamping member together while simultaneously removably coupling the front portion of the trigger guard. Placing a portion of the front portion of the trigger guard within a first trigger guard channel of a base of the receiving member; aligning the first trigger guard channel with a second trigger guard channel of the clamping member; and squeezing the front portion of the trigger guard between the first and second trigger guard channels, thereby removably coupling the front portion of the trigger guard and creating a secure and stable interface between the firearm and the tactical flashlight. Removably inserting the flashlight into a receiving through hole of a receiver of the mounting device. Determining if the flashlight is properly positioned along side the firearm so a shooter can operate the flashlight with a thumb of his non-dominant hand and adjusting the positioning of the flashlight as necessary.

In still another aspect, this document features a tactical flashlight and firearm system. The system may include: a firearm comprising a trigger guard; a mini tactical flashlight comprising a push-button tail cap switch; and a mounting device removably coupling the firearm and the flashlight together, the mounting device holding the flashlight along side the firearm so that a tail cap of the flashlight is along side a front portion of the trigger guard.

Implementations may include one or more of the following. The mounting device may be coupled to a front portion of the trigger guard. The mounting device may include a receiving member piece comprising a base having a first thickness that separates a first internal surface and a first external surface and a first trigger guard channel defined in the first internal surface at a rear end portion of the base. The receiving member piece may also include an offset, penannularly cylindrical, flashlight receiver comprising a flashlight receiving through hole and a notch extending along a longitudinal direction of the receiving through hole, the flashlight receiver integrally joined with a portion of the first external surface of the base. The mounting device may also include a clamping member piece removably coupled with the base. The clamping member may include a second thickness that separates a second internal surface and a second external surface and a second trigger guard channel defined in the second internal surface at a rear end portion of the clamping member. The offset, penannularly cylindrical, receiver may include opposing bottom and top flanges that extend outward from two sides of the notch, the top flange defining a first pair of spaced apart through holes, and the bottom flange comprising one of: a first pair of spaced apart screw rods that protrude outwardly from the bottom flange through the first pair of spaced apart through holes of the top flange; and a first pair of spaced apart threaded holes defined therein. The clamping member may include a second pair of spaced apart through holes located at a front end portion of the clamping member. The base may include one of: a second pair of spaced apart screw rods located at a front end portion of the base, the second pair of screw rods protruding outwardly from the first internal surface through the second pair of spaced apart through holes of the clamping member; and a second pair of spaced apart threaded holes defined in the first internal surface of the base at a front end portion of the base. The mounting device may include one of a first pair of nuts removably coupled with the first screw rods of the bottom flange and a first pair of screws removably coupled with the first pair of spaced apart through holes of the top flange and the first pair of spaced apart threaded holes of the bottom flange. The mounting device may include one of a second pair of nuts removably coupled with the second pair of screw rods of the base and a second pair of screws removably coupled with the second pair of spaced apart through holes of the clamping member and the second pair of spaced apart threaded holes of the base. Nuts may form a portion of the second pair of spaced apart threaded holes of the base. The mounting device may have contours in conformity with contours of the firearm. The base may include a first arcuate top surface and a first arcuate rear surface, and the clamping member piece may include a second arcuate top surface and a second arcuate rear surface having contours in conformity with contours of the firearm. A portion of an upper edge of the first external surface may be integrally joined with the receiver. The through hole of the receiver may be one of parallel to the base and at an angle with respect to the base.

These and other implementations may have one or more of the following advantages. They are suitable for use on firearms of various types and are simple in construction. They are versatile and their design accounts for the stress put on the attachment point from recoil during the firing of the firearm. They will mount an existing/off-the-shelf mini tactical flashlight to a firearm and securely maintain it thereon without gunsmithing, such as drilling holes into the gun or otherwise modifying the gun. They place the flashlight in a position along side the firearm which allows the shooter to maintain a two handed tactical grip on the gun and still operate the controls of the flashlight with the thumb of the non-dominant hand to illuminate a target while maintaining functionality of the flashlight without modifying the flashlight's controls. They are inexpensive, make use of existing flashlights and require no modifications to the firearm or flashlight or special accessory rails for mounting to the firearm. They satisfy a need for shooters who may want to own only one firearm and want to use that gun for multiple tasks. For example, they may want a compact gun to carry but also use it for home defense, and most compact handguns don't have accessory rails. Also, they extend the use of older guns which do not have accessory rails, thereby giving shooters the option of purchasing used firearms while still having the modern convenience of a firearm mounted light.

The foregoing and other aspects, features, and advantages will be apparent from the DESCRIPTION and DRAWINGS, and from the CLAIMS.

BRIEF DESCRIPTION OF THE DRAWINGS

Implementations will hereinafter be described in conjunction with the appended DRAWINGS, where like designations denote like elements.

DESCRIPTION

1. Structure

Figure 1:
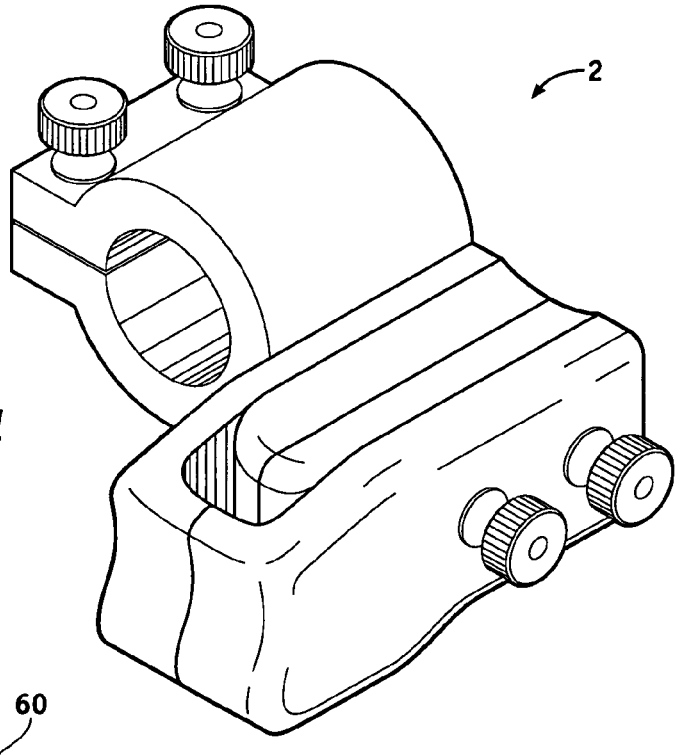
FIG. 1 is a perspective view of a mounting device implementation.
Figure 2:
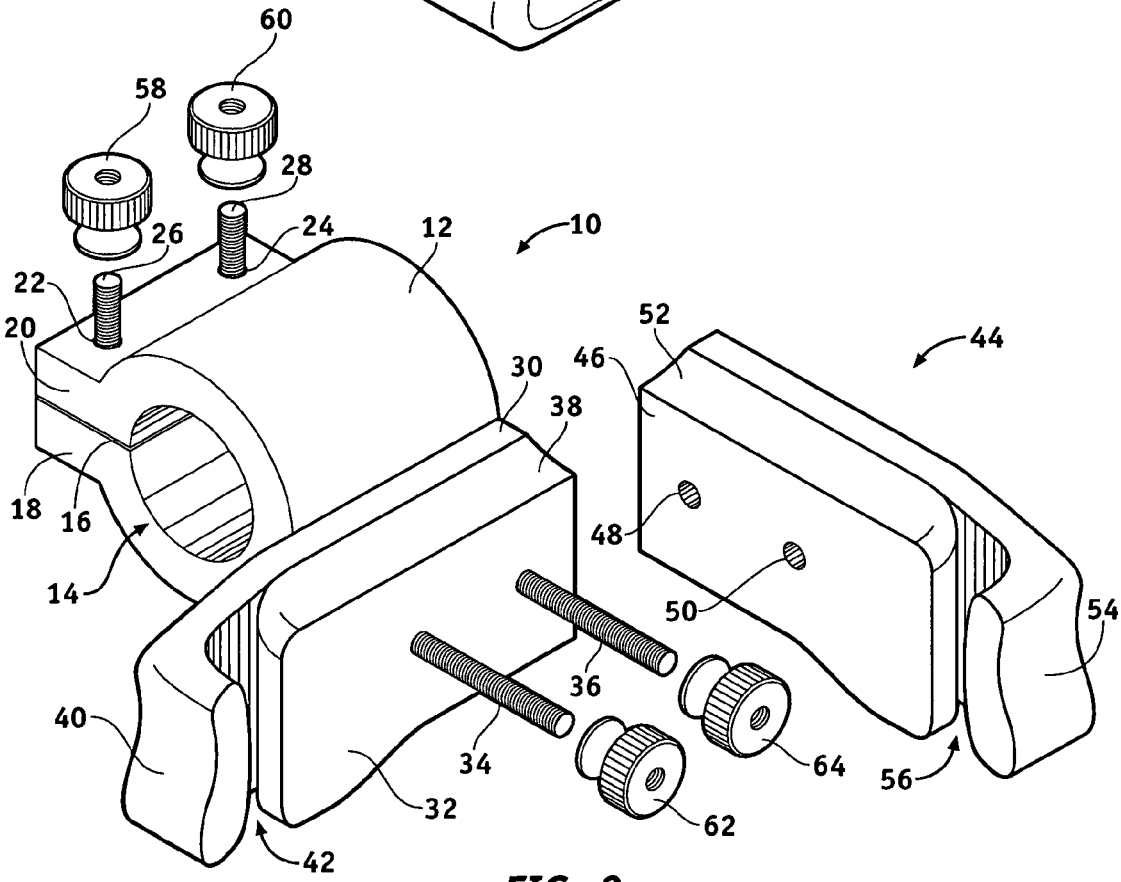
FIG. 2 is a perspective view of both a clamping member and an opposing receiving member of the mounting device of FIG. 1.
Figure 3:
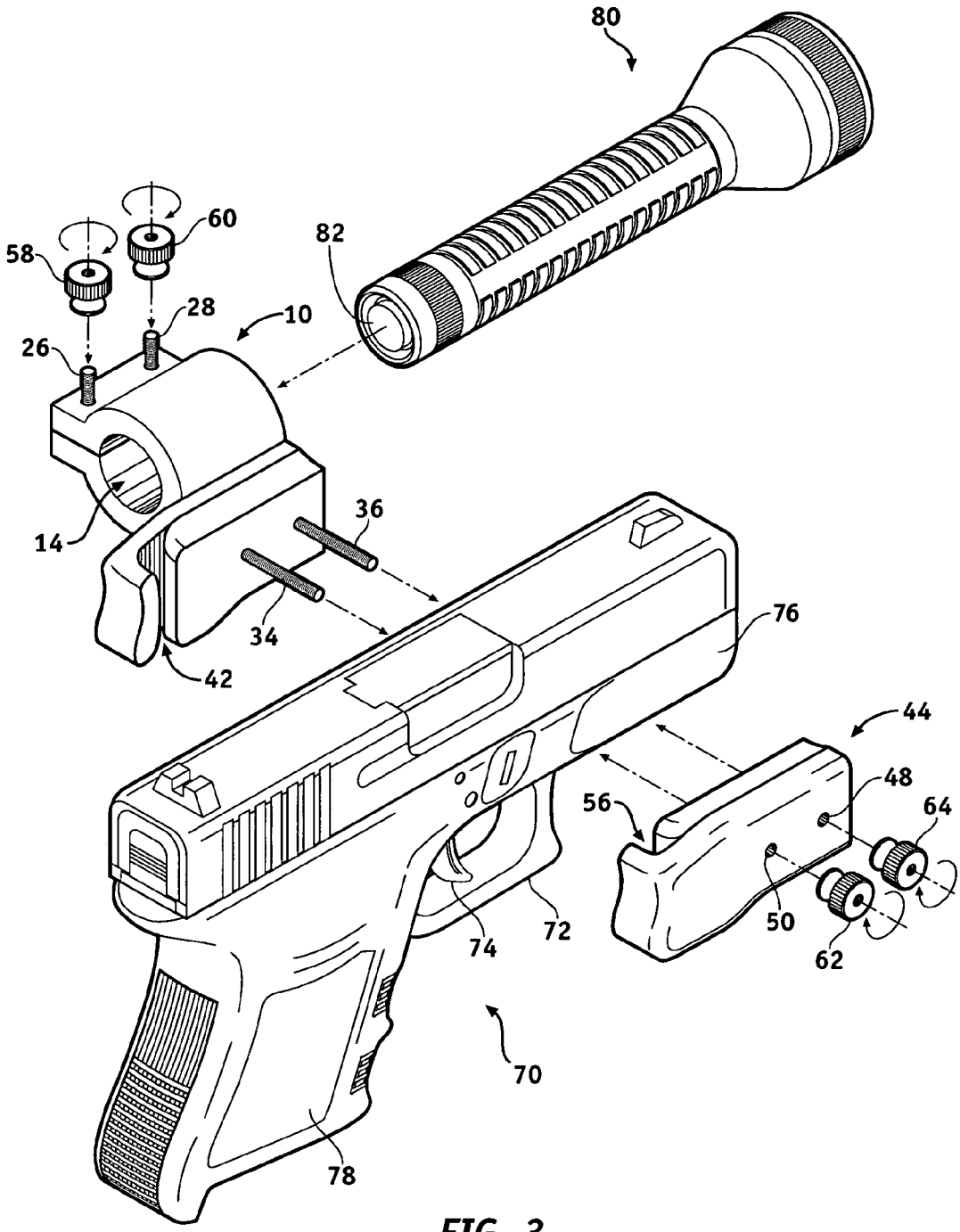
FIG. 3 is an exploded perspective view of the clamping member and the opposing receiving member of the mounting device of FIG. 1 and a mini tactical flashlight during installation thereof on a handgun.
Figure 4:
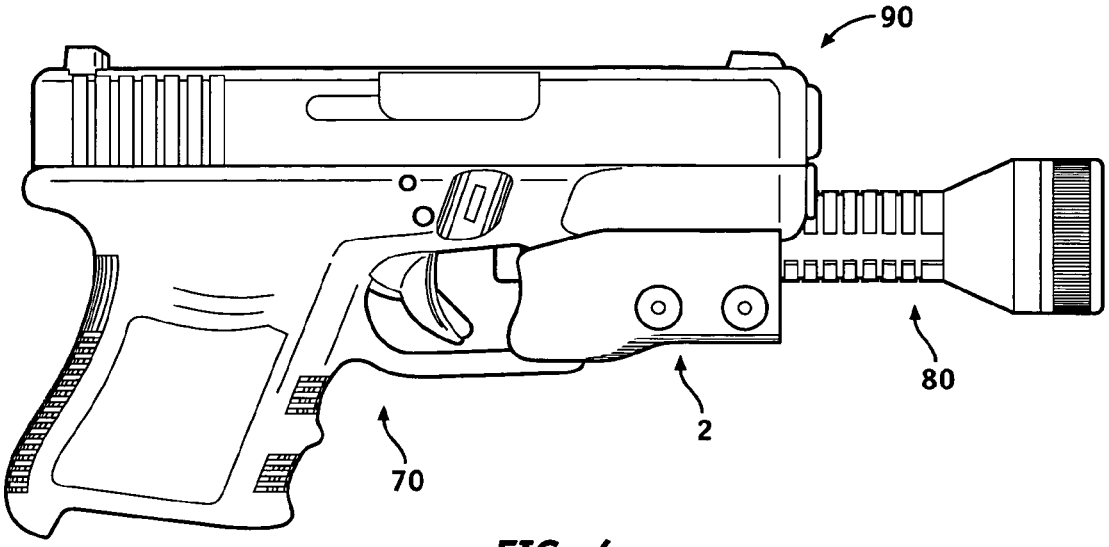
FIGS. 4–5 are right and left side elevational views respectively of a tactical flashlight and handgun system implementation.
Figure 5:
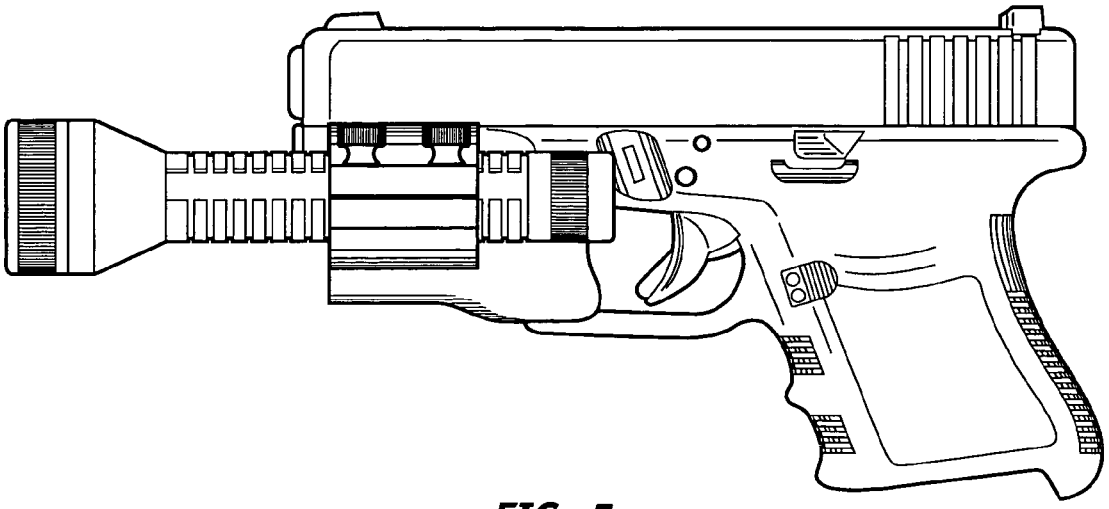
Figure 6:
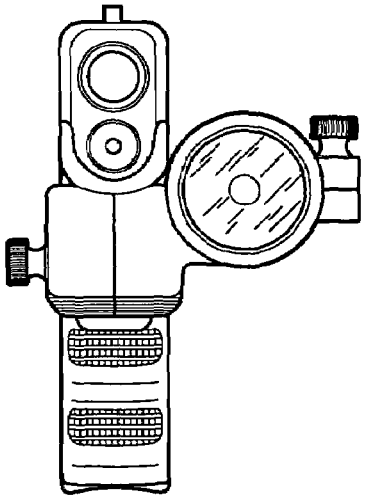
FIGS. 6–7 are front and rear elevational views respectively of the tactical flashlight and handgun system of FIG. 6.
Figure 7:
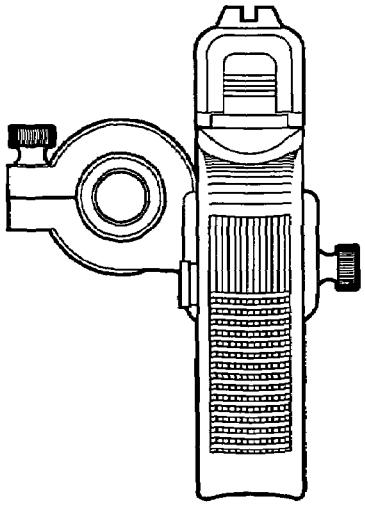
Figure 8:
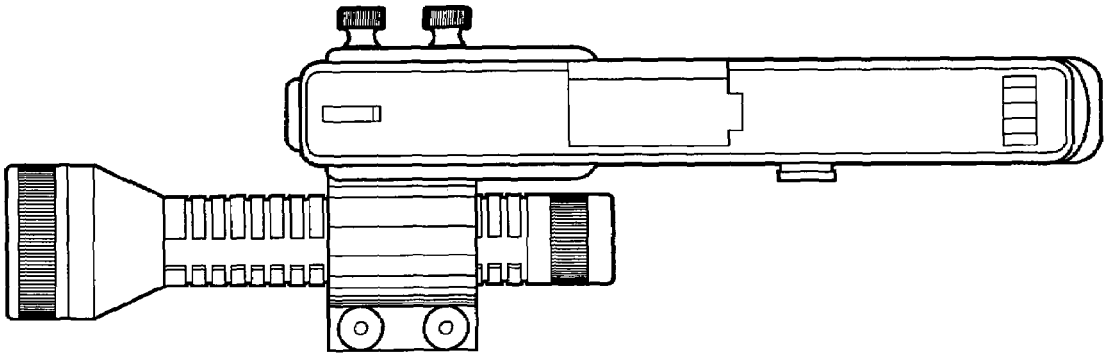
FIGS. 8–9 are top and bottom plan views respectively of the tactical flashlight and handgun system of FIG. 6.
Figure 9:
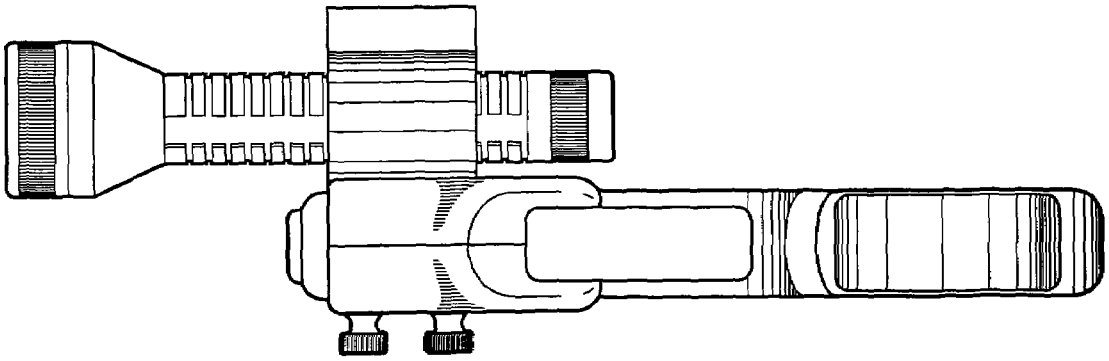

There are a variety of device implementations for removably mounting a tactical light to a firearm. Notwithstanding, with reference to FIGS. 1–2 and for the exemplary purposes of this disclosure, mounting device 2 is an example of a mounting device implementation. Generally, mounting device 2 may be comprised of two pieces, receiving member 10 and clamping member 44.

Receiving member 10 may include receiver 12 and base 30. Receiver 12 is configured to removably hold a tactical flashlight. Receiver 12 may be an offset penannularly cylindrical, flanged receiver and as such may define receiving through hole 14, which is provided in the wall thereof with notch or slot 16 extending along the longitudinal direction of through hole 14 for enabling through hole 14 to have various inner diameters. Receiver 12 may also include opposing flanges 18 and 20 that extend outward from two sides of notch 16. Flange 18 may include a pair of spaced apart securing/aligning screw rods 26 and 28 that protrude outwardly therefrom through a corresponding pair of spaced apart aligning/securing through holes 22 and 24 respectively. A flashlight may be removably and securely held in receiving through hole 14 by a pair of round thumb nuts 58 and 60, or some other hex thumb nuts, wing nuts, or the like, removably coupled with screw rods 26 and 28 respectively.

Base 30 is configured to removably couple with clamping member 44. Base 30 may include a thickness that separates internal surface 32 and an external surface, the upper edge of which is coupled or integrally joined with receiver 12. Located at a front end portion of base 30 are a pair of spaced apart securing/aligning screw rods 34 and 36 that protrude outwardly from internal surface 32. Base 30 also may include arcuate top surface 38 and arcuate rear surface 40. In this respect, arcuate top surface 38 and arcuate rear surface 40 have contours adapted to/in conformity with the receiver and the trigger guard respectively of a firearm. Arcuate rear surface 40 also does not interfere with the trigger finger of a shooter. At a rear end portion of base 30, trigger guard channel 42 is defined in internal surface 32 for receiving and accommodating a portion of the front portion of a trigger guard.

Opposing clamping member 44 is configured to removably couple with base 30. Clamping member 44 is substantially similar to base 30 and as such may include a thickness that separates internal surface 46 and an external surface. Located at a front end portion of clamping member 44 are a pair of spaced apart securing/aligning through apertures 48 and 50 corresponding to securing/aligning screw rods 34 and 36 respectively that run through the entire thickness of clamping member 44 having openings on internal surface 46 and opposing openings on the external surface. Clamping member 44 also may include arcuate top surface 52 and arcuate rear surface 54. In this respect, arcuate top surface 52 and arcuate rear surface 54 have contours adapted to/in conformity with the receiver and the trigger guard respectively of a firearm. Arcuate rear surface 54 also does not interfere with the trigger finger of a shooter. At a rear end portion of clamping member 44, trigger guard channel 56 corresponding to trigger guard channel 42 is defined in internal surface 46 for receiving and accommodating a portion of the front portion of a trigger guard. A front portion of a trigger guard of a firearm may be removably and securely held in trigger guard channel 42 and trigger guard channel 56 by a pair of round thumb nuts 62 and 64, or some other hex thumb nuts, wing nuts, or the like, removably coupled with screw rods 34 and 36 respectively.

2. Other Implementations

As mentioned earlier, many additional mounting device implementations are possible.

Although there are a variety of mounting device implementations, for the exemplary purposes of this disclosure, a mounting device implementation substantially similar to mounting device 2 as previously described may be provided. The principal difference between them relates to their receivers. In particular, through hole 14 of receiver 12 may be parallel to base 30 (and a barrel of a firearm when the mounting device implementation is installed thereon).

Although there are a variety of mounting device implementations, for the exemplary purposes of this disclosure, a mounting device implementation substantially similar to mounting device 2 as previously described may be provided. The principal difference between them relates to their receivers. In particular, through hole 14 of receiver 12 may be at an angle with respect to base 30 (and a barrel of a firearm when the mounting device implementation is installed thereon).

Although there are a variety of mounting device implementations, for the exemplary purposes of this disclosure, a mounting device implementation substantially similar to mounting device 2 as previously described may be provided. In particular, instead of a pair of spaced apart securing/aligning screw rods 26 and 28, a pair of round thumb nuts 58 and 60, a pair of spaced apart securing/aligning screw rods 34 and 36, and a pair of round thumb nuts 62 and 64, this mounting device implementation may include a pair of spaced apart aligning/securing threaded holes in flange 18 of receiver 12 of receiving member 10 corresponding to the pair of spaced apart aligning/securing through holes 22 and 24 respectively, a pair of spaced apart securing/aligning threaded holes in internal surface 32 of base 30 corresponding to the pair of spaced apart securing/aligning through holes 48 and 50 respectively, and corresponding thumb screws, washer faced thumb screws, push type thumb screws, screws requiring a driver, or the like.

Although there are a variety of mounting device implementations, for the exemplary purposes of this disclosure, a mounting device implementation substantially similar to the just described mounting device may be provided. In particular, nuts may form a portion of the spaced apart aligning/securing threaded holes to strengthen the attachment of receiving member 10 with clamping member 44.

Further implementations are within the CLAIMS.

3. Specifications, Materials, Manufacture, Assembly and Installation

It will be understood that mounting device implementations are not limited to the specific devices and components disclosed herein, as virtually any devices and components consistent with the intended operation of a mounting device implementation might be utilized. Accordingly, for example, although particular mounting devices, receiving members, receivers, holes, slots, flanges, rods, bases, surfaces, channels, clamping members, nuts, and other components are disclosed, such components may comprise any shape, size, style, type, model, version, class, grade, measurement, concentration, material, weight, quantity, and/or the like consistent with the intended operation of a mounting device implementation. Implementations are not limited to uses of any specific components, provided that the components selected are consistent with the intended operation of a mounting device implementation.

Accordingly, the components defining any mounting device implementation may be formed of any of many different types of materials or combinations thereof that can readily be formed into shaped objects provided that the components selected are consistent with the intended operation of a mounting device implementation. For example, the components may be formed of: rubbers (synthetic and/or natural) and/or other like materials; glasses (such as fiberglass), carbon-fiber, aramid-fiber, any combination thereof, and/or other like materials; polymers such as thermoplastics (such as ABS, fluoropolymers, polyacetal, polyamide; polycarbonate, polyethylene, polysulfone, and/or the like), thermosets (such as epoxy, phenolic resin, polyimide, polyurethane, silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any mounting device implementation may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

Accordingly, for the exemplary purposes of this disclosure, mounting device 2 and mini tactical flashlight 80 may be installed on handgun 70 as depicted in FIGS. 3–9. For the exemplary purposes of this disclosure, handgun 70 is a .45 Caliber Glock handgun. Handgun 70 has conventional components, including trigger guard 72, trigger 74, receiver 76, stock or handgrip 78, a barrel, a slide, and the like. Mounting device 2 has a contour adapted to/in conformity with a contour of receiver 76 of handgun 70 for mounting flashlight 80 along side or adjacent to receiver 76 so that the tail cap of flashlight 80 is adjacent the forward portion of trigger guard 72.

Mounting device 2 may be installed on handgun 70 by removably coupling receiving member 10 and clamping member 44 together while simultaneously removably coupling/sandwiching the forward portion of trigger guard 72. This may be accomplished by first placing a portion of the forward portion of trigger guard 72 within trigger guard channel 42. Next, base 30 may be coupled to clamping member 44, with internal surfaces 32 and 46 respectively abutting each other. This may be accomplished by simultaneously aligning trigger guard channel 42 with trigger guard channel 56 and through apertures 48 and 50 with screw rods 34 and 36 respectively, simultaneously squeezing the forward portion of trigger guard 72 between trigger guard channels 42 and 56 and inserting screw rods 34 and 36 through apertures 48 and 50, and removably coupling thumb nuts 62 and 64 onto screw rods 34 and 36 respectively, thereby removably coupling/sandwiching the forward portion of trigger guard 72 within mounting device 2 and creating a secure and stable interface between handgun 70 and tactical flashlight 80. Thus, even though no gunsmithing is required, mounting device 2 is, nevertheless, very securely attached to handgun 70, so that handgun 70 and mounting device 2 in effect present one integral unit.

Then, mini tactical flashlight 80 may be removably and securely coupled with receiver 12. This may be accomplished by first inserted into receiving through hole 14, and then round thumb nuts 58 and 60 may be removably coupled with screw rods 26 and 28 respectively. As a result, receiver 12 securely embraces flashlight 80.

Mounting device implementations are particularly useful in conjunction with columnar mini tactical flashlights of various dimensions having non-protruding, momentary, push-button, tailcap switch 82. Accordingly, mini tactical flashlight 80 may be any number of well-known mini tactical flashlights with tailcap switches, such as any of the mini tactical flashlights provided by and through Streamlight, Inc., 30 Eagleville Road, Eagleville, Pa. 19403. Notwithstanding, other tactical flashlights may be used, such as those produced by ASP, Beamshot, Inova, and the like for example.

Finally, a shooter may grip stock 78 with both hands 100 (a two-handed, tactical grip) to check if he may easily operate tactical flashlight 80 with the thumb of the non-dominant hand. If adjustment needs to be made, the shooter may adjust the positioning of flashlight 80 as necessary by loosening thumb screws 58 and 60, sliding flashlight in through hole 14, and retightening thumb screws 58 and 60.

Installed mounting device 2 and mini tactical flashlight 80 may be entirely or partially uninstalled by reversing some or all of the foregoing installation steps. For example, mini tactical flashlight 80 may be removed and used for other purposes, while mounting device 2 may be left mounted to handgun 70.

While the installation and uninstallation of mounting device 2 and mini tactical flashlight 80 has been described in a particular sequence of steps with reference to the drawing figures, it will be understood that the installation and uninstallation of mounting device 2 and mini tactical flashlight 80 is not limited to the specific order of steps as disclosed. Any steps or sequence of steps of the installation and uninstallation of mounting device 2 and mini tactical flashlight 80 indicated herein are given as examples of possible steps or sequence of steps and not as limitations, since various installation and uninstallation processes and sequences of steps may be used to install and uninstall mounting device 2 and mini tactical flashlight 80. Other mounting device implementations and flashlights may be installed or uninstalled in similar manners.

4. Use

Mounting device and system implementations may be used by a wide variety of shooters, such as private citizens, police officers, correctional officers, and the like, to aid in personal protection in low light conditions for example. Mounting device and system implementations may be attached to any firearm which has an unobstructed trigger guard; the firearm need not have an accessory rail. The firearm may be stored for access in an emergency situation.

Mounting device and system implementations are particularly useful with semiautomatic handguns and mini tactical flashlights. However, mounting device and system implementations are not limited to uses relating to semiautomatic handguns and mini tactical flashlights. Rather, any description relating to semiautomatic handguns, mini tactical flashlights, and the like is for the exemplary purposes of this disclosure, and implementations may also be used in a variety of applications with similar results for a variety of firearms, such as revolvers, rifles, shotguns, and the like, and/or flashlights, tactical lasers, and the like.

Figure 10:
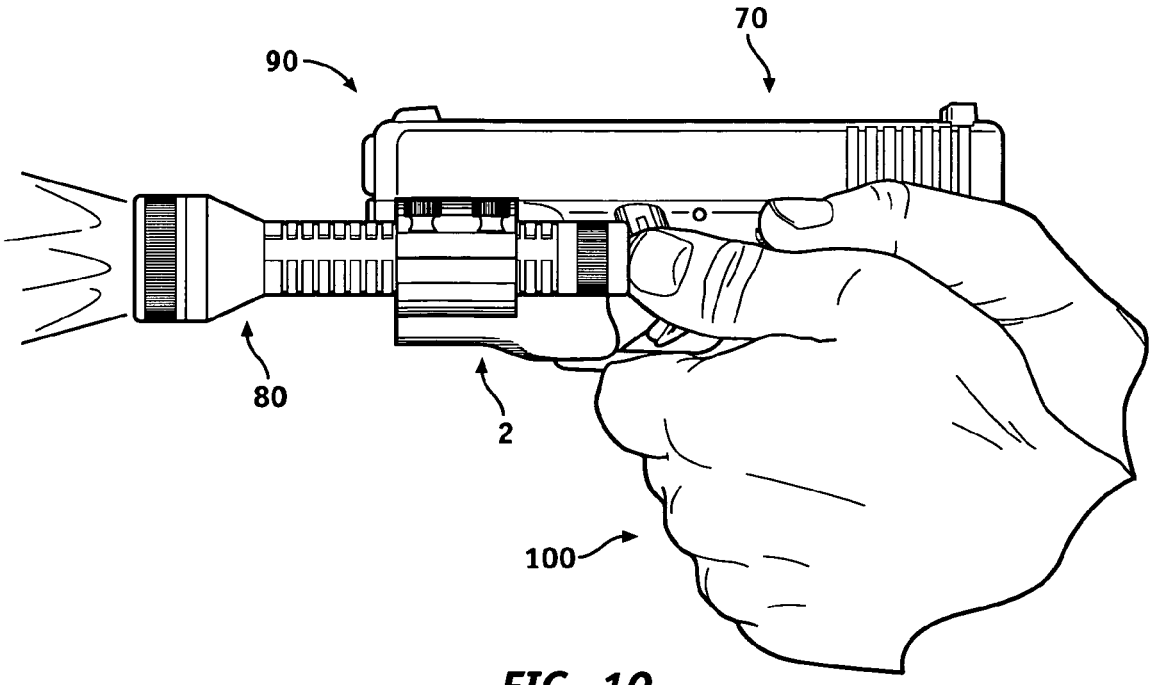
FIGS. 10–11 are left side elevational views of the tactical flashlight and handgun system of FIG. 6 during use thereof.
Figure 11:
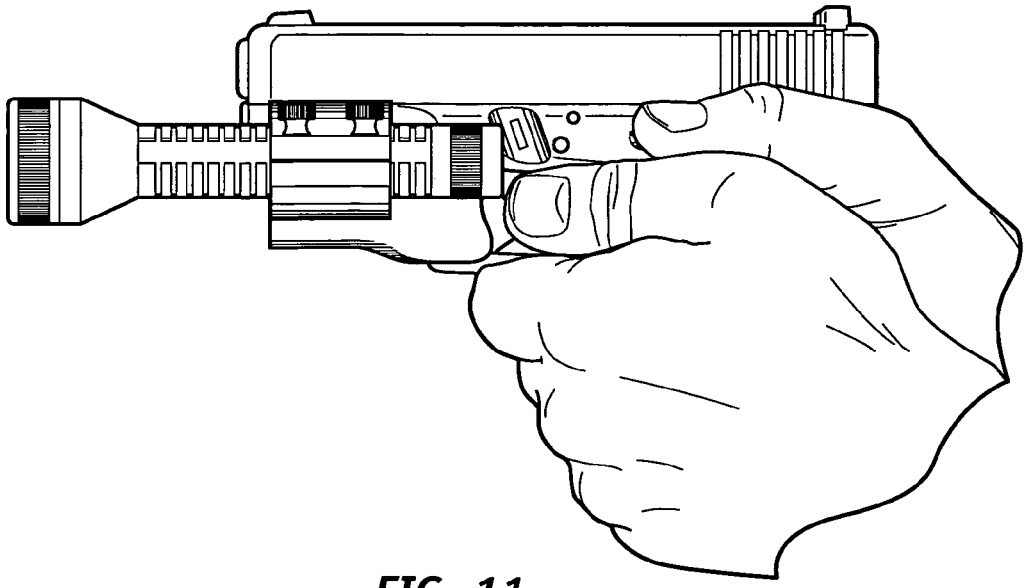

In describing the use of mounting device and system implementations further, with reference to FIGS. 10–11 and for the exemplary purposes of this disclosure, tactical flashlight and handgun system 90 is depicted. Tactical flashlight and handgun system 90 includes mounting device 2 removably holding tactical flashlight 80 adjacent handgun 70. Mounting device 2 is removably coupled to the forward portion of trigger guard 72 and holds tactical flashlight 80 adjacent to receiver 76 substantially ahead of trigger guard 72.

Because flashlight 80 is mounted along side receiver 76 and a forward portion of trigger guard 72, a shooter may grip stock 78 with both hands 100 (a two-handed, tactical grip), and may easily operate tactical flashlight 80 (without any separate special equipment) with the thumb of the non-dominant hand by pressing momentary, push-button, tailcap switch 80 as necessary. Thus, mounting device 2 supports safe gun handling practices by allowing a shooter to grip stock 78 with both hands 100 and to control illumination of the flashlight 80 without a finger being placed on trigger 74 or through trigger guard 72.

The invention claimed is:

1. A two-piece mounting device for removably mounting a tactical flashlight along side a firearm, the mounting device comprising:

a receiving member piece comprising:

a base comprising:

a first thickness that separates a first internal surface and a first external surface; and a first trigger guard channel defined in the first internal surface at a rear end portion of the base; and an offset, penannularly cylindrical, flashlight receiver comprising a flashlight receiving through hole and a notch extending along a longitudinal direction of the receiving through hole, the flashlight receiver integrally joined with a portion of the first external surface of the base; and a clamping member piece removably coupled with the base, the clamping member comprising:

a second thickness that separates a second internal surface and a second external surface; and a second trigger guard channel defined in the second internal surface at a rear end portion of the clamping member.

2. The device of claim 1:

the offset, penannularly cylindrical, receiver further comprising:

opposing bottom and top flanges that extend outward from two sides of the notch, the top flange defining a first pair of spaced apart through holes, and the bottom flange comprising one of:

a first pair of spaced apart screw rods that protrude outwardly from the bottom flange through the first pair of spaced apart through holes of the top flange; and a first pair of spaced apart threaded holes defined therein;

the clamping member further comprising a second pair of spaced apart through holes located at a front end portion of the clamping member; and the base further comprising one of:

a second pair of spaced apart screw rods located at a front end portion of the base, the second pair of screw rods protruding outwardly from the first internal surface through the second pair of spaced apart through holes of the clamping member; and a second pair of spaced apart threaded holes defined in the first internal surface of the base at a front end portion of the base; and wherein the mounting device further comprises one of a first pair of nuts removably coupled with the first screw rods of the bottom flange and a first pair of screws removably coupled with the first pair of spaced apart through holes of the top flange and the first pair of spaced apart threaded holes of the bottom flange; and wherein the mounting device further comprises one of a second pair of nuts removably coupled with the second pair of screw rods of the base and a second pair of screws removably coupled with the second pair of spaced apart through holes of the clamping member and the second pair of spaced apart threaded holes of the base.

3. The device of claim 2, wherein nuts form a portion of the second pair of spaced apart threaded holes of the base.

4. The device of claim 1, the base further comprising a first arcuate top surface and a first arcuate rear surface having contours in conformity with contours of the firearm, and the clamping member piece further comprising a second arcuate top surface and a second arcuate rear surface having contours in conformity with contours of the firearm.

5. The device of claim 1, wherein a portion of an upper edge of the first external surface is integrally joined with the receiver.

6. The device of claim 1, wherein the through hole of the receiver is one of parallel to the base and at an angle with respect to the base.

* * * * *